US006841746B2

(12) United States Patent
Wong et al.

(10) Patent No.: US 6,841,746 B2
(45) Date of Patent: Jan. 11, 2005

(54) BENT SWITCHING FLUID CAVITY

(75) Inventors: Marvin Glenn Wong, Woodland Park, CO (US); Lewis R. Dove, Monument, CO (US); Julius K. Botka, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 116 days.

(21) Appl. No.: 10/414,343

(22) Filed: Apr. 14, 2003

(65) Prior Publication Data

US 2004/0200707 A1 Oct. 14, 2004

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 3,955,059 A | * | 5/1976 | Graf | 200/181 |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | 47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99-46624 | 9/1999 |

OTHER PUBLICATIONS

Marvin Glenn Wong, U.S. Appl. No. 10/137,691 (pending), "A Piezoelectrically Actuated Liquid Metal Switch", May 2, 2002.

J. Simon, et al., "A Liquid–Filled Microrelay with a Moving Mercury Microdrop", Journal of Microelectromechanical Systems, vol. 6, No. 3, Sep. 1997, pp. 208–216.

Marvin Glenn Wong, et al., New U.S. Patent Application (13 pages specification. 7 pages of claims, 1 page abstract, and 4 sheets of drawings), "Formation of Signal Paths to Increase Maximum Signal–Carrying Frequency of a Fluid–Based Switch", Filed Apr. 14, 2003.

TDB–ACC–NO: NB8406827, "Integral Power Resistors For Aluminum Substrate", IBM Technical Disclosure Bulletin, Jun. 1984, US, vol. 27, Issue No. 1B, p. 827.

Bhedwar, Homi C., et al. "Ceramic Multilayer Package Fabrication", Electronic Materials Handbook, Nov. 1989, pp 460–469, vol. 1 Packaging, Section 4: Packages.

Kim, Joonwon, et al., "Micromechanical Switch With Electrostatically Driven Liquid–Metal Droplet", Sensors And Actuators, A; Physical v 9798, Apr. 1, 2002, 4 pages.

*Primary Examiner*—Michael A. Friedhofer

(57) ABSTRACT

A switch having first and second mated substrates that define therebetween first and second intersecting channels of a bent switching fluid cavity. A switching fluid is held within the bent switching fluid cavity and is movable between first and second switch states in response to forces that are applied to the switching fluid. More of the switching fluid is forced into the first of the intersecting channels in the first switch state, and more of the switching fluid is forced into the second of the intersecting channels in the second switch state.

19 Claims, 4 Drawing Sheets

U.S. PATENT DOCUMENTS 4,103,135 A 7/1978 Gomez et al.
4,200,779 A 4/1980 Zakurdaev et al.
4,238,748 A 12/1980 Goullin et al.
4,245,886 A 1/1981 Kolodzey et al.
4,336,570 A 6/1982 Brower et al.
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
6,647,165 B2 * 11/2003 Hu et al. ..... 385/16
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner

BENT SWITCHING FLUID CAVITY

CROSS-REFERENCE TO RELATED APPLICATIONS

This application is related to U.S. patent application Ser. No. 10/413,855, of Marvin Glenn Wong, et al., filed on the same date as this application and entitled "Formation of Signal Paths to Increase Maximum Signal-Carrying Frequency of a Fluid-Based Switch" (which is hereby incorporated by reference).

BACKGROUND

Fluid-based switches such as liquid metal micro switches (LIMMS) have proved to be valuable in environments where fast, clean switching is desired.

SUMMARY OF THE INVENTION

One aspect of the invention is embodied in a switch comprising first and second mated substrates defining therebetween first and second intersecting channels of a bent switching fluid cavity. A switching fluid is held within the bent switching fluid cavity and is movable between first and second switch states in response to forces that are applied to the switching fluid. More of the switching fluid is forced into the first of the intersecting channels in the first switch state, and more of the switching fluid is forced into the second of the intersecting channels in the second switch state.

Other embodiments of the invention are also disclosed.

DESCRIPTION OF THE DRAWINGS

Illustrative embodiments of the invention are illustrated in the drawings, in which.

DETAILED DESCRIPTION OF THE INVENTION

Figure 8:
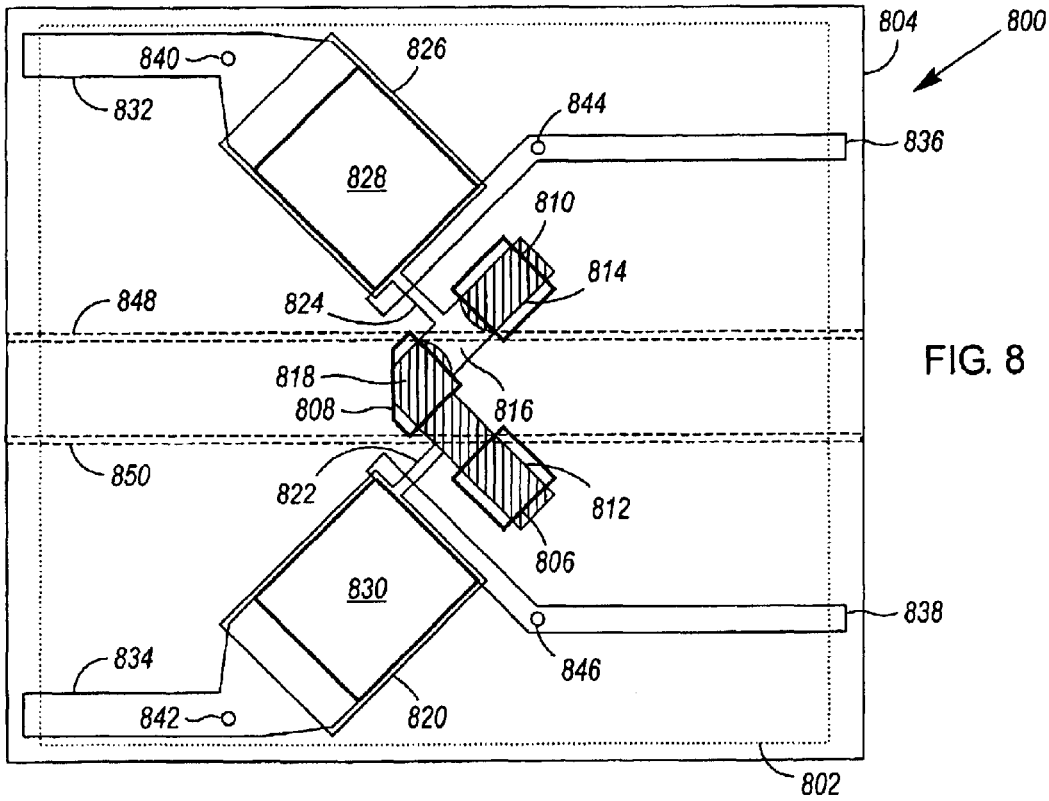
FIG. 8 is a plan view of a second exemplary embodiment of a switch.

FIGS. 1–6 illustrate a first exemplary embodiment 100 of a fluid-based switch. In this first embodiment, the switch 100 is an electrical switch. FIG. 8 illustrates a second exemplary embodiment 800 of a fluid-based switch. In this second embodiment, the switch 800 is an optical switch.

Figure 3:
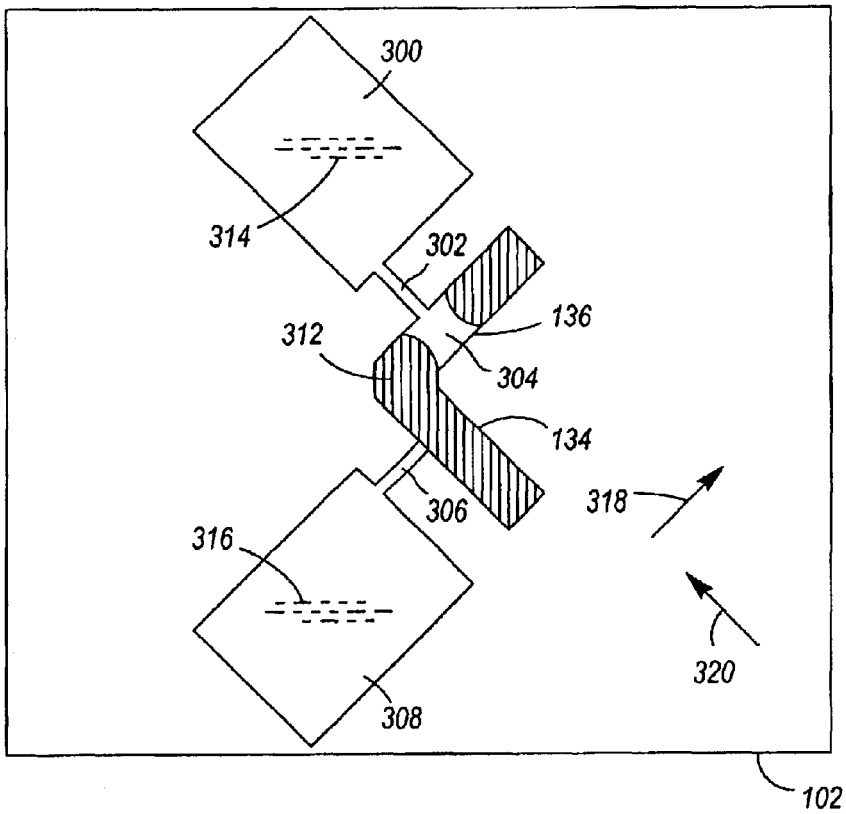
FIG. 3 is a first plan view of the channel plate of the switch shown in FIG. 1, wherein the switch is in a first state.
Figure 4:
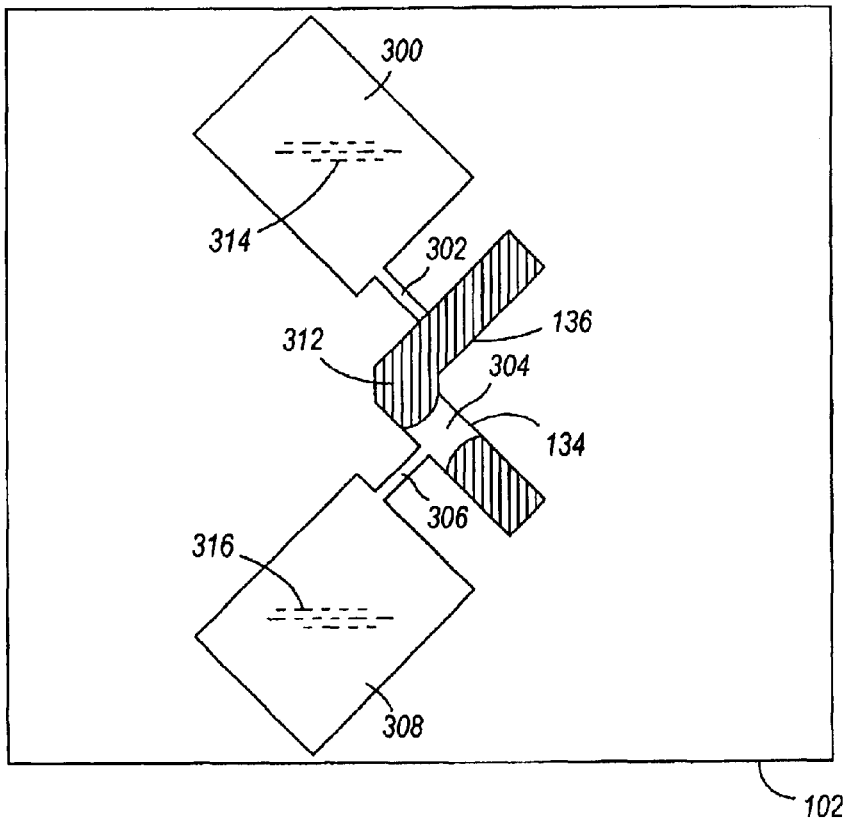
FIG. 4 is a second plan view of the channel plate of the switch shown in FIG. 1, wherein the switch is in a second state.
Figure 5:
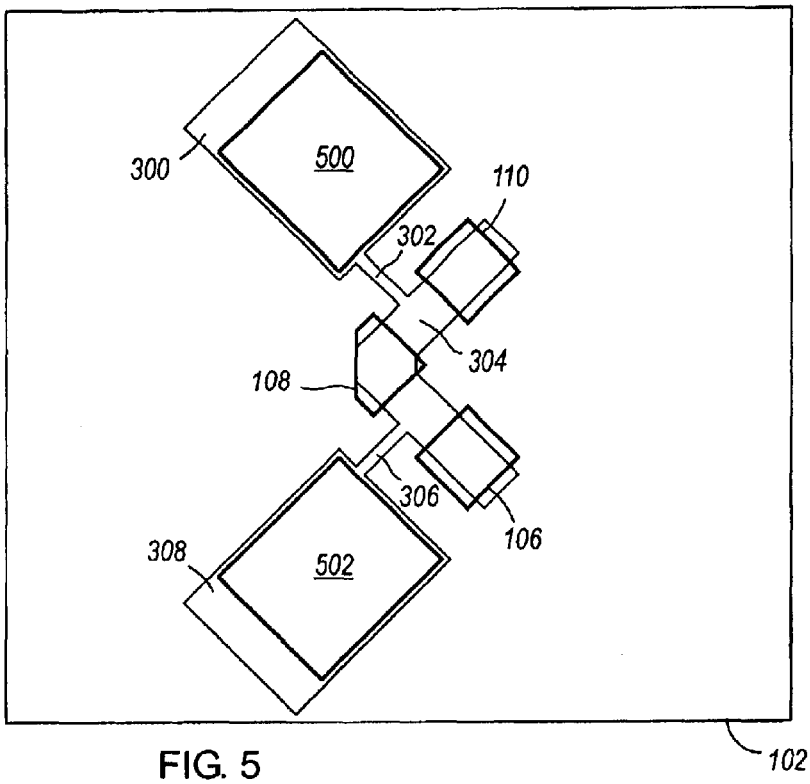
FIG. 5 is a plan view showing a correspondence of elements in/on the channel plate and substrate of the switch shown in FIG. 1.

In each of the switches 100, 800, first and second mated substrates 100/102, 800/802 define therebetween first and second intersecting channels 134/136, 812/814 of a bent switching fluid cavity 304, 816 (see FIGS. 3, 4 & 8). A switching fluid 312, 818 is held within each bent switching fluid cavity, and is movable between first and second switch states in response to forces that are applied to the switching fluid. In the first switch state, more of the switching fluid is forced into the first of the intersecting channels (as shown in FIG. 3 for switch 100). In the second switch state, more of the switching fluid is forced into the second of the intersecting channels (as shown in FIG. 4 for switch 100).

Figure 9:
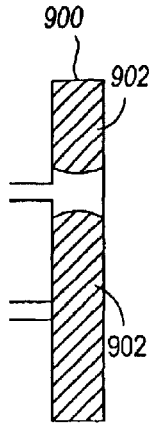
FIG. 9 is a plan view of a straight switching fluid cavity.

The bent switching fluid cavities 304, 816 provide a variety of advantages over straight switching fluid cavities, such as the one disclosed in U.S. patent application Ser. No. 10/137,691 of Marvin Glenn Wong filed May 2, 2002 and entitled "A Piezoelectrically Actuated Liquid Metal Switch" (which is hereby incorporated by reference). For example, a bent switching fluid cavity can provide better mechanical shock resistance for a fluid-based switch. This advantage can best be understood by referring to FIGS. 3, 4 & 9. As shown in FIG. 3, the switching fluid 312 moves from the state shown in FIG. 3 to the state shown in FIG. 4 by moving, generally, in the direction of arrows 318 and 320. If, for example, the switch 100 is dropped, jolted or vibrated, any forces imparted to the switching fluid 312 in the direction of arrow 320 are absorbed by the walls of channel 136, and the switching fluid is unlikely to change state as a result of the drop, jolt or vibration. In a similar manner, most forces imparted to the switching fluid 312 in the direction of arrow 318 are absorbed by the walls of channel 134. The only forces in the direction of arrow 318 that are not absorbed are those resulting from that portion of the switching fluid 312 which is held at the intersection of the channels 134 and 136. However, because the mass of the switching fluid 312 held at the intersection of the channels 134 and 136 is much less than the mass of the entirety of the switching fluid 312 held in channel 134, switching fluid 312 held in the bent switching fluid cavity 304 is much less likely to inadvertently change state than a similar quantity of switching fluid 902 held in a similarly sized straight switching fluid channel 900 (see FIG. 9; Force=mass×acceleration). If a wettable area 108 (e.g, a pad, contact, or seal belt; see FIG. 1) is positioned at the bend of switching fluid cavity 304, surface tension of the switching fluid 312 can make it relatively easy to counter the non-absorbed forces (i.e., forces not absorbed by the walls of cavity 304) that are imparted to the switching fluid 312 during drops, jolts or vibrations of switch 100. More specific details concerning exemplary arrangements of switch parts for the purpose of achieving such mechanical shock resistance are disclosed later in this description. However, another potential advantage of a bent switching fluid cavity will be described first.

Another potential advantage of a bent switching fluid cavity 304 is that it may be electrically advantageous to use such a bent-shaped cavity 304. For example, a bent switching fluid cavity 304 may allow sharp turns in a switch's electrical paths to be eased by enabling "flattening" of the transitions where planar signal conductors 112, 114, 116 contact a switching fluid 312.

The embodiment of a fluid-based switch 100 shown in FIGS. 1–6 will now be described in greater detail. The switch 100 comprises a channel plate 102 that defines at least a portion of a number of cavities 300, 302, 304, 306, 308 (FIG. 3). One or more of the cavities may be at least partly defined by first and second intersecting channels 134, 136 in the channel plate 102. The remaining portions of the cavities 300–308, if any, may be defined by a substrate 104 that is mated and sealed to the channel plate 102. The first and second intersecting channels 134, 136 may intersect at various angles, including an angle of about 90°.

The channel plate 102 and substrate 104 may be sealed to one another by means of an adhesive, gasket, screws (providing a compressive force), and/or other means. One suitable adhesive is Cytop™ (manufactured by Asahi Glass Co., Ltd. of Tokyo, Japan). Cytop™ comes with two different adhesion promoter packages, depending on the application. When a channel plate 102 has an inorganic composition, Cytop™'s inorganic adhesion promoters should be used. Similarly, when a channel plate 102 has an organic composition, Cytop™'s organic adhesion promoters should be used.

As shown in FIG. 3, a switching fluid 312 (e.g., a conductive liquid metal such as mercury) is held within the cavity 304 defined by the intersecting channels 134, 136. The switching fluid 312 is 1) movable between at least first and second switch states in response to forces that are applied to the switching fluid 312, and 2) serves to open and close at least a pair of electrical contacts (e.g., contact pads 106, 108, 110) exposed within the cavity 304.

Figure 1:
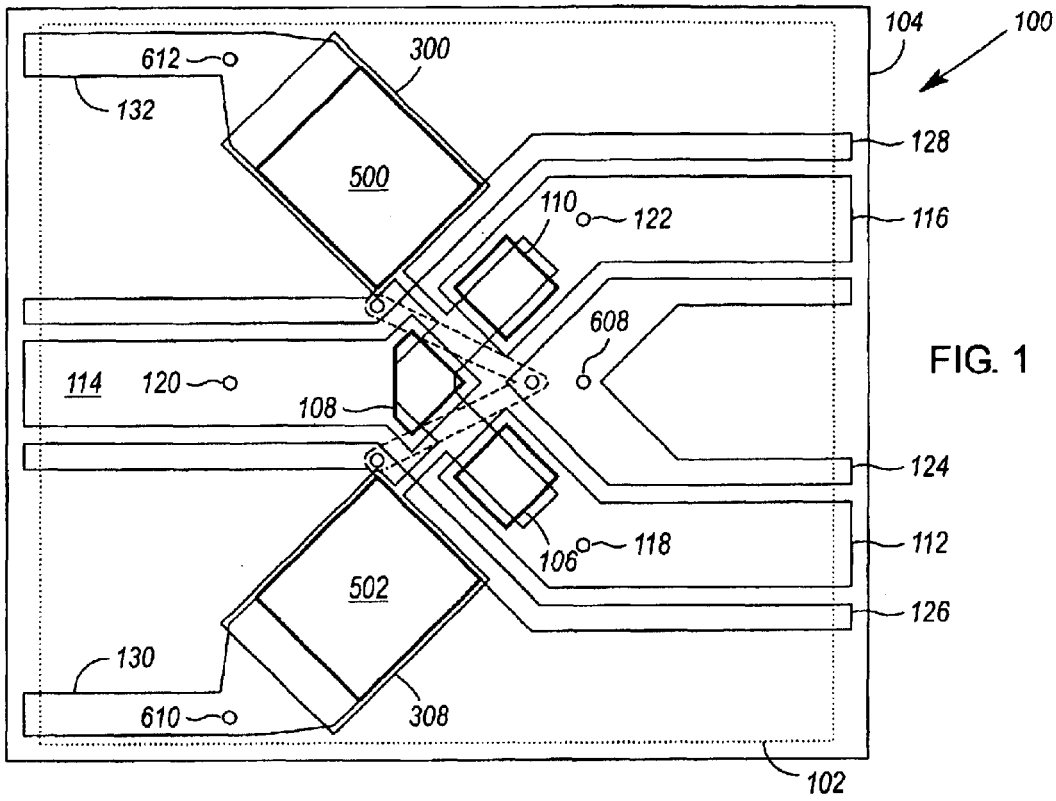
FIG. 1 is a plan view of a first exemplary embodiment of a switch.

FIG. 3 illustrates the switching fluid 312 in a first state. In this first state, there is a gap in the switching fluid 312 in front of cavity 302. The gap is formed as a result of forces that are applied to the switching fluid 312 by means of an actuating fluid 314 (e.g., an inert gas or liquid) held in cavity 300. In this first state, the switching fluid 312 wets to and bridges contact pads 106 and 108 (FIGS. 1 & 3). The switching fluid 312 may be placed in a second state by decreasing the forces applied to it by means of actuating fluid 314, and increasing the forces applied to it by means of actuating fluid 316. In this second state, a gap is formed in the switching fluid 312 in front of cavity 306, and the gap shown in FIG. 3 is closed. In this second state, the switching fluid 312 wets to and bridges contact pads 108 and 110 (FIGS. 1 & 4).

Figure 6:
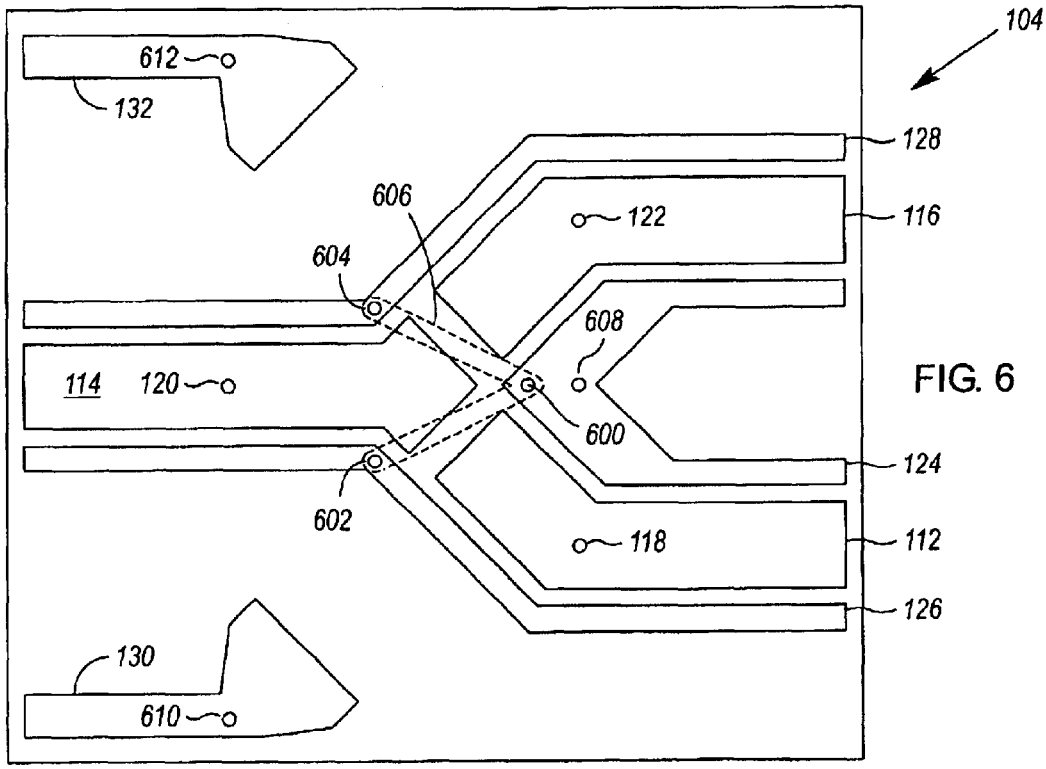
FIG. 6 is a plan view of the substrate of the switch shown in FIG. 1.
Figure 7:
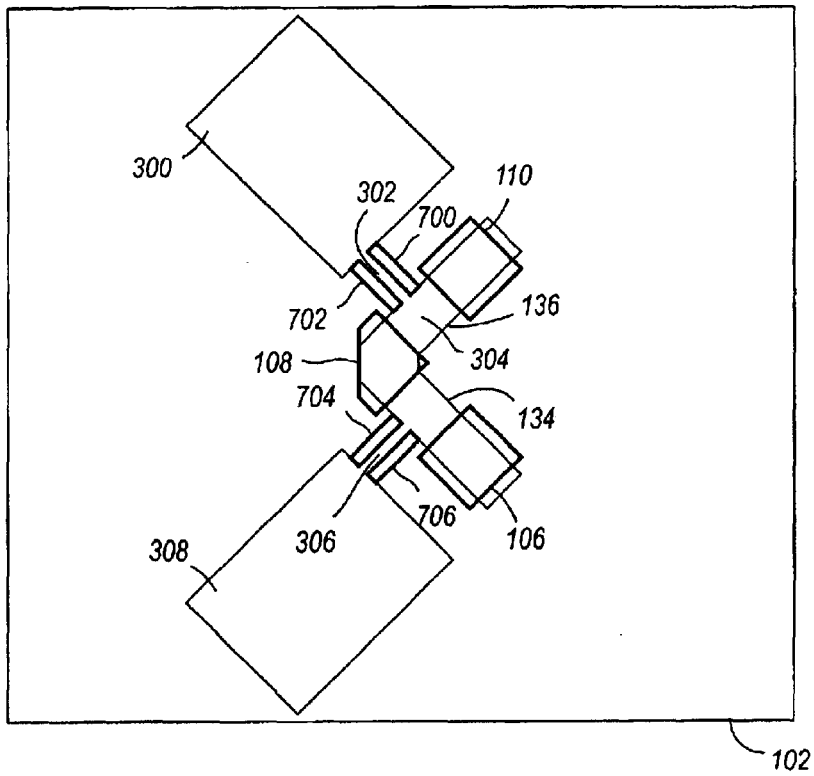
FIG. 7 is a plan view illustrating an alternate embodiment of the switch shown in FIG. 1.

As shown in FIGS. 1 & 6, a plurality of planar signal conductors 112, 114, 116 extend from edges of the switch 100 to within the cavity 304 defined by the bent switching fluid cavity 304. When the switch 100 is assembled, these conductors 112–116 are in wetted contact with the switching fluid 312. The ends 106–110 of the planar signal conductors 112–116 to which the switching fluid 312 wets may be plated (e.g., with Gold or Copper), but need not be. The ends of the planar signal conductors 112–116 that extend to the edges of the switch 100 may extend exactly to the edge of the switch 100, or may extend to within a short distance of the exact edge of the switch 100 (as shown in FIG. 1). For purposes of this description, the conductors 112–116 are considered to extend to a switch's "edges" in either of the above cases. In an alternate embodiment of switch 100, the planar signal conductors 112–116 might not extend to the edges of the switch 100.

Use of the planar signal conductors 112–116 for signal propagation eliminates the routing of signals through vias, and thus eliminates up to four right angles that a signal would formerly have had to traverse (i.e., a first right angle where a switch input via 120 is coupled to a substrate, perhaps at a solder ball or other surface contact; a second right angle where the switch input via 120 is coupled to internal switch circuitry 114; a third right angle where the internal switch circuitry 116 is coupled to a switch output via 122; and a fourth right angle where the switch output via 122 is coupled to the substrate). Elimination of these right angles eliminates a cause of unwanted signal reflection, and reductions in unwanted signal reflection tend to result in signals propagating more quickly through the affected signal paths.

Figure 2:
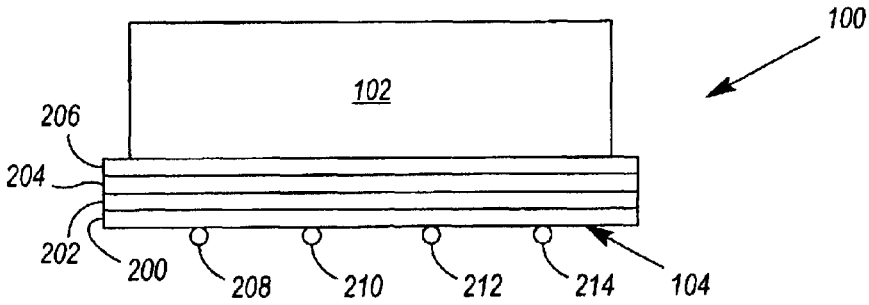
FIG. 2 illustrates an elevation of the layers of the switch shown in FIG. 1.

Realizing that not all environments may be conducive to edge coupling of the switch 100, the switch 100 may also be provided with a plurality of conductive vias 118, 120, 122 for electrically coupling the planar signal conductors 112–116 to a plurality of surface contacts such as solder balls (see solder balls 208, 210, 212, 214 in FIG. 2, for example). Alternately, the vias 118–122 could couple the planar signal conductors 112–116 to other types of surface contacts (e.g., pins, or pads of a land grid array (LGA)).

To further increase the speed at which signals may propagate through the switch 100, a number of planar ground conductors 124, 126, 128 may be formed adjacent either side of each planar signal conductor 112–116 (FIGS. 1 & 6). The planar signal and ground conductors 112–116, 124–128 form a planar coaxial structure for signal routing, and 1) provide better impedance matching, and 2) reduce signal induction at higher frequencies.

As shown in FIGS. 1 & 6, a single ground conductor may bound the sides of more than one of the signal conductors 112–116 (e.g., ground conductor 124 bounds sides of signal conductors 112 and 116). Furthermore, the ground conductors 124–128 may be coupled to one another within the switch 100 for the purpose of achieving a uniform and more consistent ground. If the substrate 104 comprises alternating metal and insulating layers 200–206 (FIG. 2), then the ground conductors 124–128 may be formed in a first metal layer 206, and may be coupled to a V-shaped trace 606 in a second metal layer 202 by means of a number of conductive vias 600, 602, 604 formed in an insulating layer 204.

Similarly to the planar signal conductors 112–116, the planar ground conductors 124–128 may extend to the edges of the switch 100 (but need not) so that they may be coupled to a printed circuit board or other substrate via wirebonds. However, again realizing that not all environments may be conducive to edge coupling of the switch 100, the ground conductors 124–128 may also be coupled to a number of conductive vias 608 that couple the ground conductors 124–128 to a number of surface contacts of the switch 100.

In the above description, it was disclosed that switching fluid 312 could be moved from one state to another by forces applied to it by an actuating fluid 314, 316 held in cavities 300, 308. However, it has yet to be disclosed how the actuating fluid 314, 316 is caused to exert a force (or forces) on switching fluid 312. One way to cause an actuating fluid (e.g., actuating fluid 314) to exert a force is to heat the actuating fluid 314 by means of a heater resistor 500 that is exposed within the cavity 300 that holds the actuating fluid 314. As the actuating fluid 314 is heated, it tends to expand, thereby exerting a force against switching fluid 312. In a similar fashion, actuating fluid 316 can be heated by means of a heater resistor 502. Thus, by alternately heating actuating fluid 314 or actuating fluid 316, alternate forces can be applied to the switching fluid 312, causing it to assume one of two different switching states. Additional details on how to actuate a fluid-based switch by means of heater resistors are described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference.

Another way to cause an actuating fluid 314 to exert a force is to decrease the size of the cavities 300, 302 that hold the actuating fluid 314. FIG. 10 therefore illustrates an alternative embodiment of the switch 100, wherein heater resistors 500, 502 are replaced with a number of piezoelectric elements 700, 702, 704, 706 that deflect into cavities 302, 306 when voltages are applied to them. If voltages are alternately applied to the piezoelectric elements 700, 702 exposed within cavity 302, and the piezoelectric elements 704, 706 exposed within cavity 306, alternate forces can be applied to the switching fluid 312, causing it to assume one of two different switching states. Additional details on how to actuate a fluid-based switch by means of piezoelectric pumping are described in the previously mentioned patent application of Marvin Glenn Wong (U.S. patent application Ser. No. 10/137,691).

Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity.

To enable faster cycling of the afore-mentioned heater resistors 500, 502 or piezoelectric elements 700–706, each may be coupled between a pair of planar conductors 130/126, 132/128 that extend to a switch's edges. As shown in FIG. 1, some of these planar conductors 126, 128 may be the planar ground conductors that run adjacent to the planar signal conductors 112–116. If desired, conductive vias 610, 612 may be provided for coupling these conductors 130, 132 to surface contacts on the switch 100.

An advantage provided by the bent switching fluid cavity 304 is that signals propagating into and out of the switching fluid 312 held therein need not take right angle turns, and thus unwanted signal reflections can be reduced. That is, the tightest angle at which any of the planar signal conductors 112–116 intersects the bent switching fluid cavity 304 may be confined to an angle of greater than 90° (and preferably an angle that is equal to or greater than 135°, or an angle that is about 135°). Thus, in an ideal connection environment, the switch 100 illustrated in FIGS. 1–6 can be used to eliminate all right angle turns in signal paths, thereby reducing signal reflections, increasing the speed at which signals can propagate through the switch, and ultimately increasing the maximum signal-carrying frequency of the switch 100.

To make it easier to couple signal routes to the switch 100, it may be desirable to group signal inputs on one side of the switch, and group signal outputs on another side of the switch. If this is done, it is preferable to limit the tightest corner taken by a path of any of the planar signal conductors to greater than 90°, or more preferably to about 135°, and even more preferably to equal to or greater than 135° (i.e., to reduce the number of signal reflections at conductor corners).

It should be noted that the conductive vias 118–122, 608–612 shown in FIGS. 1 & 6 could be eliminated to keep signal inductance to a minimum, thereby increasing the maximum signal-carrying frequency of the switch 100.

If the switch 100 is electrically coupled to a substrate via surface contacts (e.g., solder balls 208–214), the planar conductors 112–116, 124–132 need not extend to the edges of the switch 100. However, the switch 100 can still benefit from signal paths with acute angle corners and/or a bent switching fluid cavity 304, even though signals will need to propagate into the switch 100 via right angle turns at solder balls 208–214 and conductive vias 118–122, 608–612.

FIG. 8 illustrates an optical switch 800 employing a bent switching fluid cavity 816. The switch 800 comprises a channel plate 802, first and second intersecting channels 812, 814, substrate 804, cavities 816, 820, 822, 824, 826, heater resistors 828, 830, heater resistor conductors 832, 834, 836, 838, and conductive vias 840, 842, 844, 846 that function similarly to corresponding components described with respect to the switch 100 (FIGS. 1–6). The optical switch 800 has the same mechanical shock resistance as the electrical switch 100. However, in lieu of having electrical contacts exposed within the bent switching fluid cavity 816, the switch 800 has a plurality of wettable pads 806–810 exposed within the bent switching fluid cavity 816. The switching fluid 818 wets to the pads 806–810 similarly to how the switching fluid 312 wets to the contact pads 106–110 (FIGS. 1, 3 & 4), and serves to open and block light paths 848, 850 through the bent switching fluid cavity 816.

Although the above description has been presented in the context of the switches 100, 800 shown and described herein, application of the inventive concepts is not limited to the fluid-based switches shown herein.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, comprising:

a) first and second mated substrates defining therebetween first and second intersecting channels of a bent switching fluid cavity; and b) a switching fluid, held within the bent switching fluid cavity, that is movable between first and second switch states in response to forces that are applied to the switching fluid; wherein more of the switching fluid is forced into the first of the intersecting channels in the first switch state, and wherein more of the switching fluid is forced into the second of the intersecting channels in the second switch state.

2. The switch of claim 1, further comprising:

a) a first wettable area that presents within the bent switching fluid cavity at the intersection of the first and second intersecting channels; and b) second and third wettable areas that present within the bent switching fluid cavity on either side of the intersection of the first and second intersecting channels.

3. The switch of claim 1, wherein the first and second intersecting channels intersect at an angle of about 90°.

4. The switch of claim, 1 further comprising:

a) a plurality of surface contacts; and b) a plurality of conductive vias that electrically couple ones of the electrical contacts to the surface contacts.

5. A switch, comprising:

a) a channel plate defining at least a portion of a number of cavities, said number of cavities including a bent switching fluid cavity defined by at least first and second intersecting channels in the channel plate;

b) a plurality of electrical contacts exposed within the bent switching fluid cavity;

c) a switching fluid, held within the bent switching fluid cavity, that serves to open and close at least a pair of the plurality of electrical contacts in response to forces that are applied to the switching fluid; and d) an actuating fluid, held within one or more of the cavities, that serves to apply said forces to the switching fluid.

6. The switch of claim 5, wherein:

a) one of the electrical contacts presents within the bent switching fluid cavity at the intersection of the first and second intersecting channels; and b) different ones of the electrical contacts present within the bent switching fluid cavity on either side of the intersection of the first and second intersecting channels.

7. The switch of claim 6, wherein the electrical contacts are wetted by the switching fluid.

8. The switch of claim 5, wherein the first and second intersecting channels intersect at an angle of about 90°.

9. The switch of claim 6, wherein the electrical contacts are ends of planar signal conductors.

10. The switch of claim 9, wherein at least one of the planar signal conductors intersects the bent switching fluid cavity at an angle, and wherein a tightest angle at which one of the planar signal conductors intersects the bent switching fluid cavity is greater than 90°.

11. The switch of claim 10, wherein the tightest angle at which one of the planar signal conductors intersects the bent switching fluid cavity is equal to or greater than 135°.

12. The switch of claim 10, wherein the tightest angle at which one of the planar signal conductors intersects the bent switching fluid cavity is about 135°.

13. The switch of claim 12, wherein a path taken by one of the planar signal conductors comprises a corner, and wherein a tightest corner in a path taken by any of the planar signal conductors is greater than 90°.

14. The switch of claim 13, wherein the tightest corner in a path taken by any of the planar signal conductors is about 135°.

15. The switch of claim 14, further comprising planar ground conductors adjacent either side of each planar signal conductor.

16. The switch of claim 13, wherein the tightest corner in a path taken by any of the planar signal conductors is equal to or greater than 135°.

17. A switch, comprising:

a) a channel plate defining at least a portion of a number of cavities, said number of cavities including a bent switching fluid cavity defined by at least first and second intersecting channels in the channel plate;

b) a plurality of wettable pads exposed within the bent switching fluid cavity;

c) a switching fluid, wettable to said pads and held within the bent switching fluid cavity, that serves to open and block light paths through the bent switching fluid cavity in response to forces that are applied to the switching fluid; and d) an actuating fluid, held within one or more of the cavities, that serves to apply said forces to the switching fluid.

18. The switch of claim 17, wherein:

a) one of the wettable pads presents within the bent switching fluid cavity at the intersection of the first and second intersecting channels; and b) different ones of the wettable pads present within the bent switching fluid cavity on either side of the intersection of the first and second intersecting channels.

19. The switch of claim 17, wherein the first and second intersecting channels intersect at an angle of about 90°.

* * * * *